United States Patent [19]

Gibbon et al.

[11] Patent Number: 4,699,540

[45] Date of Patent: Oct. 13, 1987

[54] EXPANSION JOINT

[75] Inventors: Robert M. Gibbon; J. William Houtz, both of Fort Worth, Tex.

[73] Assignee: JMK International, Inc., Fort Worth, Tex.

[21] Appl. No.: 848,926

[22] Filed: Apr. 7, 1986

[51] Int. Cl.[4] ..... E01C 11/06; E01C 11/10

[52] U.S. Cl. ..... 404/49; 404/64; 404/67; 404/74

[58] Field of Search ..... 404/49, 64, 65, 67–69, 404/74; 52/396, 403; 49/489

[56] References Cited

U.S. PATENT DOCUMENTS

| | | | |
|---|---|---|---|
| 3,108,813 | 10/1963 | Brown et al. | 404/49 X |
| 3,134,047 | 3/1964 | Graham | 404/47 |
| 3,377,226 | 4/1968 | Renwick | 52/403 X |
| 3,387,544 | 6/1968 | MacLellan et al. | 404/65 |
| 3,504,597 | 4/1970 | Pare | 404/67 |
| 3,521,528 | 7/1970 | Wangerow | 404/69 |
| 3,718,403 | 2/1973 | Kerschner | 404/49 |
| 3,829,228 | 8/1974 | Miyazaki et al. | 404/68 |
| 3,870,424 | 3/1975 | Koester et al. | 404/67 |
| 4,080,086 | 3/1978 | Watson | 404/69 |
| 4,098,047 | 7/1978 | Weber | 404/68 |
| 4,127,350 | 11/1978 | Weber | 404/65 |
| 4,131,382 | 12/1978 | Hymo | 404/69 |
| 4,279,532 | 7/1981 | Miller et al. | 404/68 |
| 4,279,533 | 7/1981 | Peterson et al. | 404/68 |
| 4,285,612 | 8/1981 | Betti | 404/68 |
| 4,362,430 | 12/1982 | Ceintrey | 404/68 |

FOREIGN PATENT DOCUMENTS

| | | | |
|---|---|---|---|
| 213596 | 6/1967 | Sweden | 52/396 |

OTHER PUBLICATIONS

E-Poxy Industries, Inc. advertisement for CEVA TM Expansion-Contraction Joint Systems, 1979, p. 6.

*Primary Examiner*—Stephen J. Novosad
*Assistant Examiner*—Matthew Smith
*Attorney, Agent, or Firm*—James E. Bradley

[57] ABSTRACT

An expansion joint is shown for use in joining adjacent concrete sections separated by an expansion slot such as in a roadway having concrete sections and a slot therebetween. The joint includes a preformed longitudinal sealing element which is formed of a resilient material and installed within the slot. An initially flowable adhesive material is applied between the sealing element and opposing side surfaces of the concrete sections making up the joint. The moduli of elasticity of the adhesive material and sealing element are selected so that forces exerted upon the joint by expansion and contraction of the concrete sections result in movement of the central sealing element, rather than exerting strain upon the adhesive bond.

4 Claims, 4 Drawing Figures

EXPANSION JOINT

BACKGROUND OF THE INVENTION

1. Field of the Invention

The present invention relates to expansion joints of the type which enable adjacent concrete sections separated by an expansion slot to expand and contract. More specifically, the invention relates to roadway expansion joints which seal out water and debris on the roadway surface from entering the expansion slot.

2. Description of the Prior Art

Concrete roadways are made with concrete sections which are separated by expansion slots to accommodate thermal expansion and contraction of the roadway. In the prior art, roadway joints were sometimes sealed by first inserting a rod or other rigid insert within the slot and then applying a caulking material to form a seal over the top of the joint. The caulking materials used included tar and bituminous elastomer mixes, and the like. This type joint has been found to be problematical because of a lack of adhesion between the caulking material and the adjacent concrete sections. This loss in adhesion is due to the movement of the concrete which causes a strain on the adhesive bond between the caulking material and the concrete. Once the seal is lost, water and debris from the roadway can intrude between the concrete sections and deteriorate the roadway. An example of such a sealed construction is shown in U.S. Pat. No. 3,124,047, issued Mar. 10, 1964, to Graham.

In another type of prior art joint, a rubber compression seal is compressed and inserted into the slot of the joint. This type seal also fails with time, since continued expansion and contraction movement of the concrete sections eventually cause the resilient material to take a "set" so that subsequent expansion of the concrete sections results in a leak occurring. Compression type seals are shown in U.S. Pat. Nos. 3,718,403; 3,387,544; and 3,521,528, for instance.

It is also known to use a metal plate to bridge the expansion slot, the plate being secured to the recess in one of the concrete sections and being movable relative to recesses in the other of the concrete sections. The recessed portions above the plate are typically filled with an elastomeric material. Such a joint is shown, for instance, in U.S. Pat. No. 4,279,533, issued July 21, 1981, to Peterson et al. Other of the prior art joints have included premolded members which were mechanically secured within the slots as by bolts. These solutions are less than satisfactory in that they lack durability or require very demanding quality control in construction.

The present invention has as its object, the provision of a roadway expansion joint which effectively prevents the intrusion of water and debris from the roadway surface over an extended time period.

The invention also has as its object the provision of such an expansion joint which can be produced at low cost and with excellent quality control.

SUMMARY OF THE INVENTION

The expansion joint of the invention is designed for use in a roadway having concrete sections with upper surfaces aligned to form the roadway surface and spaced from each other to provide an expansion slot, each concrete section having at the end thereof adjacent the slot a recess which extends longitudinally of the slot and which has a bottom surface generally parallel to the roadway surface and opposing side surfaces extending from the bottom surface to the roadway surface. A preformed longitudinal sealing element formed of a resilient material is first installed within the recess in a relaxed state. Preferably, the longitudinal sealing element is formed from a heat cured silicon rubber. An initially flowable adhesive material is then applied between the sealing element and each of the opposing side surfaces of the recess to effect an adhesive bond. The adhesive material is capable of setting after application to effect the adhesive bond. The sealing element and adhesive material are each selected to have a modulus of elasticity which differs by a predetermined amount, the ratio of the modulus of elasticity of the adhesive material to that of the sealing element being at least 2:1. The initially flowable adhesive material is preferably RTV silicone adhesive material.

Additional objects, features and advantages will be apparent in the written description which follows.

DETAILED DESCRIPTION OF THE DRAWINGS

DETAILED DESCRIPTION OF THE INVENTION

Figure 1:
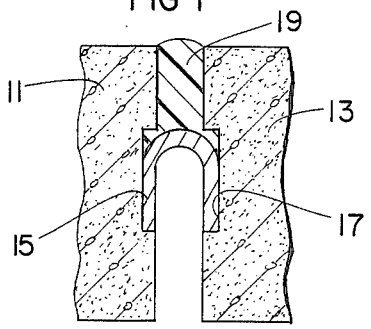
FIG. 1 is a side, cross-sectional view of a prior art sealing joint for a roadway.

FIG. 1 shows a prior art sealing joint for a roadway for sealing between adjacent concrete sections 11, 13. The joint includes a preformed rigid rod 15 of generally U-shaped cross-sectional area which is first inserted within the recess 17. A caulking material 19 is then inserted within the joint on top of the rod 15.

Figure 2:
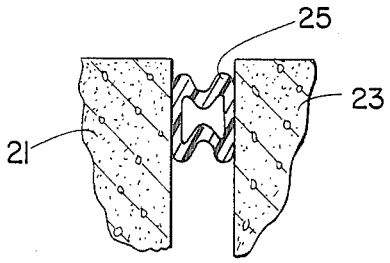
PRIOR ART FIG 2
FIG. 2 is a side, cross-sectional view of another prior art sealing joint for a roadway.

FIG. 2 shows another prior art joint for sealing between concrete sections 21, 23. In the joint of FIG. 2, a rubber member 25 is compressed and installed between the concrete sections 21, 23 under a compressive loading to form a seal for the joint.

As has been discussed, the joint of FIG. 1 was subject to failure because of the separation of the caulk material 19 from the adjacent concrete sections during expansion and contraction of the joint. The joint of FIG. 2 was subject to failure with time because repeated expansion and contraction forced the compressed member 25 to take a "set" so that the member failed to expand during subsequent expansion cycles and maintain a seal.

Figure 3:
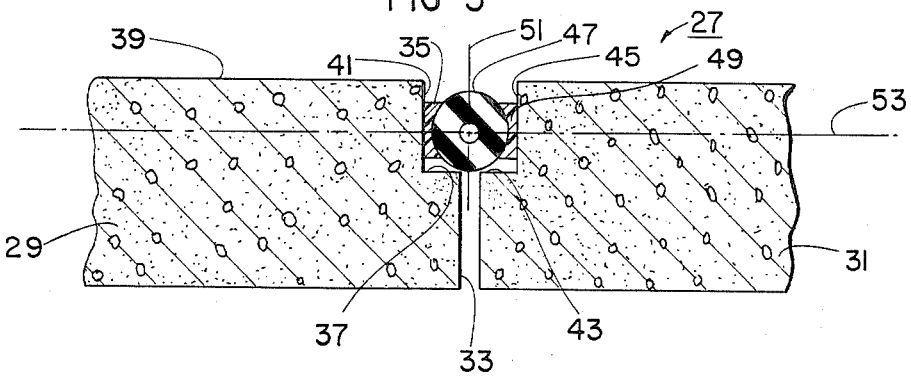
PRIOR ART FIG 3
FIG. 3 is a side, cross-sectional view of the sealing joint of the invention.
Figure 4:
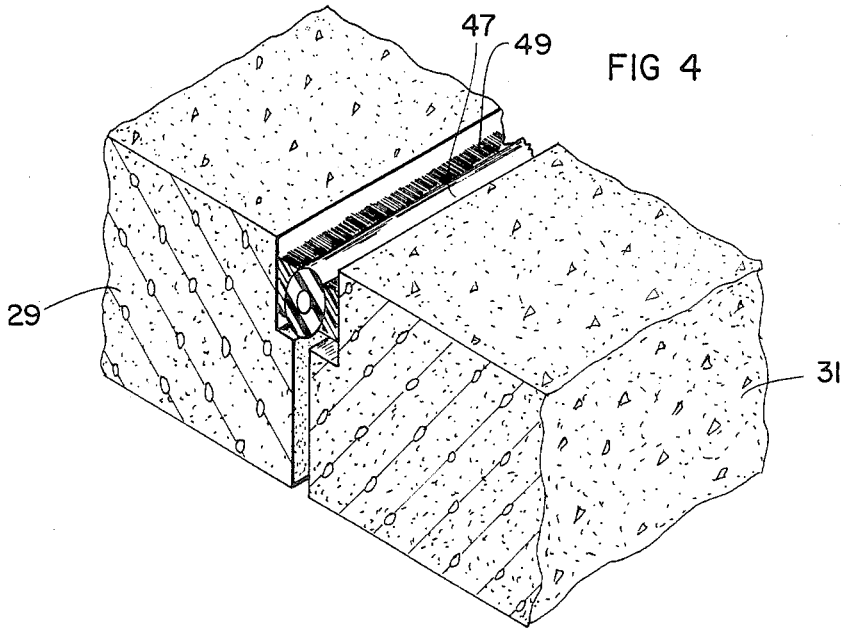
FIG. 4 is an elevated view, partly in section, of the sealing joint of the invention.

FIG. 3 is a cross-sectional view of the expansion joint of the invention designated generally as 27. As shown in FIG. 3, the two adjacent concrete roadway sections 29, 31 are spaced apart by an expansion slot 33. The edge of the concrete section 29 adjacent slot 33 has a recess 35, the bottom surface 37 of which is in a plane substantially parallel to the plane of the roadway surface 39, and the side surface 41 of which extends from the roadway surface 39 to the bottom surface 37 of the recess. The other concrete section 31 is similarly provided with a bottom surface 43 and side surface 45.

The expansion joint 27 includes a preformed longitudinal sealing element 47 formed of a resilient material and installed within the recess 35. The sealing element 47 is preferably formed from a heat cured silicone rubber and has a tube-shape which gives the element a cylindrical cross-sectional area, as shown in FIG. 3. The following example is a typical formulation for the heat curable silicone elastomer used in forming the sealing element 47:

| | | |
|---|---|---|
| (a) | Methyl Vinyl Polysiloxane Gum 0.2 mole percent vinyl content | 11.7 parts |
| (b) | Di-Methyl Polysiloxane Gum | 63.5 parts |
| (c) | Structural Control Additives | 7.9 parts |
| (d) | Fume Silica | 16.4 parts |
| (e) | Heat Stabilizers | 0.4 parts |
| | | 100.0 parts |

In forming the longitudinal sealing element useful in the joint of the invention, the above composition is pigmented and then catalyzed with a peroxide catalyst, such as 2.4 dichloro benzoyl peroxide, present at about 0.5 parts per hundred parts of the above composition.

The composition is extruded through a die followed by heat treatment either by heating in an air tunnel or heating in a salt bath. The resultant silicone rubber has a modulus of elasticity at 100 percent elongated of 20 to 25 psi.

After installing the sealing element within the recess 35 in a relaxed state so that no compressive force is exerted against the adjacent side surfaces 41, 45, an initially flowable adhesive material is applied between the sealing element and each of the opposing side surfaces 41, 45, to effect an adhesive bond therebetween. The adhesive material is preferably an RTV (room temperature vulcanizable) silicone adhesive material which is capable of setting after application to effect an adhesive bond with the sealing element 47. Such silicone adhesive materials are well known in the building trades and can be of either the "acetoxy" type of the "non-acetoxy" type.

The adhesive material and sealing element material are selected to have a modulus of elasticity which differs by a predetermined amount so that expansion and contraction forces acting upon the joint result primarily in movement of the sealing element and not in movement of the adhesive material during use. In testing various combinations of sealing elements and adhesive materials, it was observed that in joining rubber-like materials of dissimilar moduli and then exerting a stretching force on these materials, that the elongation in each of the two rubber-like materials is proportional to their individual modulus. These test results are shown in Table I. Thus, Table I shows the force in psi required to elongate various rubber-like materials (designated A and B) by 100 percent of their original length. By selecting an adhesive material having a modulus of elasticity which is at least twice that of the modulus of the sealing element, and preferably at least three to four times the modulus of that of the sealing element, expansion and contraction forces on the bonded materials results in movement only of the lower modulus material, and in practically no movement of the higher modulus adhesive material.

TABLE I

| | 100% MODULI OF 2 RUBBERS | | MOVEMENT OF EACH RUBBER | |
|---|---|---|---|---|
| TEST | A | B | A | B |
| 1 | 300 psi | 20 psi | NIL | 100% |
| 2 | 100–600 psi | 25 psi | NIL | 100% |
| 3 | 70 psi | 25 psi | 45% | 55% |

TABLE I-continued

| | 100% MODULI OF 2 RUBBERS | | MOVEMENT OF EACH RUBBER | |
|---|---|---|---|---|
| TEST | A | B | A | B |
| 4 | 50 psi | 25 psi | 50% | 50% |

With the foregoing in mind, the sealing element 47 and adhesive material 49 were selected with predetermined moduli to remove the strain of expansion and contraction forces from the RTV adhesive bond with the concrete sections. By matching the moduli as described, any strain can be eliminated on the adhesive bond to the concrete sections and all the movement resulting from the expansion and contraction forces is taken up by the lower modulus profile material.

In other words, in using a sealing element having a modulus at 100 percent elongation of 20 to 25 psi, the adhesive material should have a modulus at 100 percent elongation of greater than about 50 psi. Most preferably, the modulus of the adhesive material will be in the range from about 90–100 psi.

The bond strength between the adhesive material 49 and the concrete side surfaces 41, 45 can also be improved by using a suitable primer upon the surfaces prior to applying the adhesive material. A suitable primer can be obtained from Dow Corning as the "1250 Primer."

As shown in FIG. 3, the cross-section area of the sealing element 47, as viewed from one end of the sealing element, defines a first diametric line 51 approximately vertical to the roadway surface 39 and a second diametric line 53 in a plane approximately parallel to the roadway surface 39 which intersects the first diametric line at a right angle in the approximate center of the sealing element 47. As shown in FIG. 3, the adhesive material 49 is applied on the exterior of the sealing element 47 in an area approximately 30° above to approximately 30° below the second diametric line as viewed from the end of the sealing element in FIG. 3. The adhesive material 49 does not cover the opening of recess 35 or form a cap over the top exterior surface of the sealing element 47. Similarly, the adhesive material 49 does not completely bridge the area over the slot 33 beneath the bottom exterior surface of the sealing element 47. The sealing element 47 and the adhesive material 49 occupy substantially all of the remaining space within the recess 35 without protruding above the surface 39.

Another formulation used for forming the sealing element 47 of the invention is:

| | | |
|---|---|---|
| (a) | Methyl Vinyl Polysiloxane Gum 0.2 mole percent vinyl content | 53 parts |
| (b) | Dimethyl Polysiloxane Gun | 22 parts |
| (c) | Structural Control Additives | 5.3 parts |
| (d) | Fume Silica | 16.6 parts |
| (e) | Heat Stabilizers | 0.3 parts |
| (f) | Reinforcing Filler | 2.8 parts |
| | | 100 parts |

As in the first example, this compound was pigmented and catalyzed with a peroxide catalyst. The catalyzed material was extruded and heat cured resulting in a tube-shaped profile having a cylindrical cross-sectional area and a central opening or a void space. The modulus at 100 percent elongation of this sealing element was 30 psi. The sealing element was placed in the recess of a roadway joint and Dow Corning "Silastic 734" RTV silicone adhesive was injected into the recess on either side of the sealing element between the sealing element and the side surfaces of the concrete sections. The joint was allowed to set for 48 hours, after which adhesion was found to be excellent in both air and water.

An invention has been provided with several advantages. The roadway expansion joint of the invention is extremely durable and provides long term assurance against the entrance of water or road debris into the expansion slot, while at the same time enabling free expansion and contraction of the concrete sections. The predetermined moduli criteria for the sealing element and adhesive material provide a joint which imparts ample elasticity to the total joint to allow for expansion and contraction while insuring the integrity of the adhesive bond between the sealing element and side surfaces of the concrete sections. The joint of the invention can be provided at low cost with excellent quality control. Because of the tube-shape of the sealing element, there is no particular orientation which must be satisfied during the installation procedure. Also, should the top exterior surface of the tube become punctured, the bottom surface of the tube continues to seal the slot in the joint from water or debris.

While the invention has been shown in only one of its forms, it is not thus limited but is susceptible to various changes and modifications without departing from the spirit thereof.

We claim:

1. An expansion joint for use in joining concrete sections with upper surfaces aligned to form a horizontal plane and spaced from each other to provide an expansion slot, each concrete section having at the end thereof adjacent said slot a recess which extends longitudinally of the slot and which has a bottom surface generally parallel to the horizontal plane and opposing side surfaces extending from said bottom surface to the horizontal plane, the improvement comprising:

a preformed longitudinal sealing element formed of a resilient material and installed within said recess; and an initially flowable rubber-like adhesive material applied between said sealing element and each of said opposing side surfaces of said recess to effect an adhesive bond therebetween, said adhesive material being capable of setting after application to effect said adhesive bond, the sealing element material and adhesive material each being selected to have a modulus of elasticity which differs by a predetermined amount, the ratio of the modulus of elasticity of the adhesive material to that of the sealing element material at one hundred percent elongation being at least 2:1.

2. An expansion joint for use in joining concrete sections with upper surfaces aligned to form a horizontal plane and spaced from each other to provide an expansion slot, each concrete section having at the end thereof adjacent said slot a recess which extends longitudinally of the slot and which has a bottom surface generally parallel to the horizontal plane and opposing side surfaces extending from said bottom surface to the horizontal plane, the improvement comprising:

a preformed longitudinal sealing element formed from heat cured silicone rubber and installed within said recess, the sealing element being a tube-shaped member; and an RTV silicon adhesive material applied between said sealing element and each of said opposing side surfaces of said recess to effect an adhesive bond therebetween, said adhesive material being capable of setting after application to effect said adhesive bond, the sealing element material and adhesive material each being selected to have a modulus of elasticity which differs by a predetermined amount so that expansion and subsequent contraction forces acting upon the joint result primarily in movement of the sealing element and not in movement of the adhesive material, the ratio of the modulus of elasticity of the adhesive material to that of the sealing element material at one hundred percent elongation being at least 2:1.

3. A method of constructing an expansion joint for use in a roadway having concrete sections with upper surfaces aligned to form the roadway surface and spaced from each other to provide an expansion slot, each concrete section having at the end thereof adjacent said slot a recess which extends longitudinally of the slot and which has a bottom surface generally parallel to the roadway surface and opposing side surfaces extending from said bottom surface to the roadway surface, the method comprising the steps of:

installing a preformed longitudinal sealing element along substantially the entire length of the slot within said recess, the sealing element being a tube-shaped member having a cylindrical cross-sectional area, the longitudinal sealing element being installed in a substantially relaxed state without exerting compressive loading upon the opposing side surfaces of said recess;

selecting an initially flowable rubber-like adhesive material to apply between said sealing element and each of said opposing side surfaces of said recess, the adhesive material and the sealing element material each being selected to have a modulus of elasticity which differs by a predetermined amount so that expansion and subsequent contraction forces acting upon the joint result primarily in movement of the sealing element and not in movement of the adhesive material, the ratio of the modulus of elasticity of the adhesive material to that of the sealing element material at one hundred percent elongation being at least 2:1;

applying the initially flowable adhesive material between said sealing element and each of said opposing side surfaces of said recess to effect an adhesive bond therebetween; and allowing the adhesive material to set to effect an adhesive bond between said sealing element and said opposing side surfaces of said recess to thereby seal the joint.

4. A method of constructing an expansion joint for use in a roadway having concrete sections with upper surfaces aligned to form the roadway surface and spaced from each other to provide an expansion slot, each concrete section having at the end thereof adjacent said slot a recess which extends longitudinally of the slot and which has a bottom surface generally parallel to the roadway surface and opposing side surfaces extending from said bottom surface to the roadway surface, the method comprising the steps of:

installing a preformed longitudinal sealing element along substantially the entire length of the slot within said recess, the longitudinal sealing element being formed from a heat cured silicone rubber in a tube-shape having a cylindrical cross-sectional area and being installed in a substantially relaxed state;

selecting an initially flowable, RTV silicone adhesive material to apply between said sealing element and each of said opposing side surfaces of said recess, the adhesive material and the sealing element material each being selected to have a modulus of elasticity which differs by a predetermined amount so that expansion and subsequent contraction forces acting upon the joint result primarily in movement of the sealing element and not in movement of the adhesive material, the ratio of the modulus of elasticity of the adhesive material to that of the sealing element material at one hundred percent elongation being at least 2:1;

applying the initially flowable adhesive material between said sealing element and each of said opposing side surfaces of said recess to effect an adhesive bond therebetween; and allowing the adhesive material to set to effect an adhesive bond between said sealing element and said opposing side surfaces of said recess to thereby seal the joint.

* * * * *